United States Patent [19]

Goldberg et al.

[11] Patent Number: 4,708,687

[45] Date of Patent: Nov. 24, 1987

[54] ROLLING FIGURE TOY

[75] Inventors: Benjamin L. Goldberg, Hartford; Dominic G. Mercurio, Elmwood, both of Conn.

[73] Assignee: Coleco Industries, Inc., West Hartford, Conn.

[21] Appl. No.: 827,794

[22] Filed: Feb. 7, 1986

[51] Int. Cl.[4] ..... A63H 7/00; A63H 3/46

[52] U.S. Cl. ..... 446/269; 446/376

[58] Field of Search ..... 446/269, 376, 328, 375, 446/321

[56] References Cited

U.S. PATENT DOCUMENTS

| | | | |
|---|---|---|---|
| 152,250 | 6/1874 | Powers . | |
| 497,159 | 5/1893 | Allen . | |
| 1,880,109 | 9/1932 | Sanders | 446/376 |
| 1,918,754 | 7/1933 | Johnson | 446/376 X |
| 2,118,677 | 5/1938 | Lower . | |
| 2,751,634 | 6/1956 | Washington . | |
| 2,884,739 | 5/1959 | Ketcham | 446/376 |
| 3,099,895 | 8/1963 | Beebe | 446/376 |
| 3,475,042 | 10/1969 | Speers et al. | 446/378 X |
| 3,777,740 | 4/1968 | Bonanno et al. . | |
| 4,169,336 | 10/1979 | Kuhn . | |
| 4,268,991 | 5/1981 | Cotey et al. . | |
| 4,274,224 | 6/1981 | Pugh et al. | 446/375 |
| 4,286,407 | 9/1981 | Adickes, Jr. et al. | 446/375 |
| 4,411,097 | 10/1983 | Murakami . | |

*Primary Examiner*—Philip C. Kannan

[57] ABSTRACT

A humanoid toy figure is constructed to fold from an erect posture to a curled, generally cylindrical configuration in which it will roll upon a flat surface. Desirable body features are afforded by molding the trunk member of the figure as separate lateral sections, and manufacture of the toy is relatively facile and inexpensive.

16 Claims, 6 Drawing Figures

ROLLING FIGURE TOY

BACKGROUND OF THE INVENTION

An ongoing demand exists for action toys having novel features. It is of course important that any such toy be effective in its appearance and operation, while being durable and relatively facile and inexpensive to manufacture. The prior art discloses numerous forms of action toys in which various parts can be moved and disposed in different ways; typical are the following U.S. patents:

Powers U.S. Pat. No. 152,250 discloses an articulated figure which is assembled with and retractable into a spherical or spheroidal shell.

Allen U.S. Pat. No. 497,159 discloses a ship-like object comprised of parts which can be folded into an egg-shaped body with which they are joined.

An articulated, configuration-changing structure, made of pivotally connected blocks, is described in Washington U.S. Pat. No. 2,751,634.

Lower U.S. Pat. No. 2,118,677 shows a doll construction wherein a connector made of a flexible elastic material is used for maintaining the appendages in assembly with the body.

Bonanno et al U.S. Pat. No. 3,377,740 discloses a doll having spring-loaded arms mounted upon a common shaft.

A toy figure having body parts that are stretchable and capable of forming various shapes is taught by Kuhn in U.S. Pat. No. 4,169,336.

In Cotey et al U.S. Pat. No. 4,268,991, appendages of an articulated doll are attached to an internal skeleton by ball and socket arrangements.

Murakami discloses a toy doll in U.S. Pat. No. 4,411,097, wherein the appendages collapse into the box-like trunk of the figure.

It is an object of the present invention to provide a novel humanoid figure toy which is constructed to permit folding from a substantially erect posture to a substantially cylindrical curled configuration.

It is a more specific object of the invention to provide such a novel toy wherein the body parts and appendages are relatively rigid, and are shaped and joined to one another in such a manner as to permit the necessary conformation for facile folding.

Another object of the invention is to provide a novel toy of the foregoing nature wherein external features of the several parts enable rolling in its curled configuration.

An additional object of the invention is to provide convenient means for mounting the appendages upon the trunk member of such a toy, which means permits facile pivoting of the appendages while at the same time affording sufficient frictional resistance for maintaining the figure parts in selected relative positions.

Additional objects of the invention are to provide such a toy figure which is effective in its appearance and utility, is durable, and is of relatively facile and inexpensive manufacture.

SUMMARY OF THE INVENTION

It has now been found that certain of the foregoing and related objects of the invention are attained by the provision of a humanoid figure toy comprised of trunk, thigh, leg and foot members, articulated by joints at hip, knee and ankle locations. The members and joints are constructed to permit folding of the toy from a generally erect posture to a curled configuration with a generally cylindrical surface contour.

The thigh member will normally be foldable anteriorly, to a position substantially against the chest portion of the trunk member, and the leg and foot members will be foldable posteriorly to positions substantially against the rear portion of the thigh member. Preferably, the trunk member will be of hunched form, with a concave chest portion for accommodating the thigh member thereagainst in the curled configuration and with a back portion that is longitudinally curved to provide an arcuate section of the cylindrical surface.

The toy will generally include a head member having a curved upper portion, which provides an arcuate section of the cylindrical surface closely adjacent to, and substantially continuous with, the arcuate section of the back portion of the trunk member. Each of the thigh, leg and foot members will normally comprise a pair of symmetrically disposed components, with the interconnecting joints providing two articulated leg appendages. The leg and foot components will desirably have shin and instep portions defining arcuate sections of the cylindrical surface, and they, along with the trunk member back portion, may have longitudinal ridges thereon for that purpose.

In particularly preferred embodiments, the longitudinal ridges of the back portion will be disposed to either side of a recessed spinal area of the trunk member. To facilitate manufacture, in such a case, the trunk member may be an assembly comprised of three sections, two laterial sections being of substantially mirror image form, taken through the medial plane of the member, and the third being an elongated panel disposed therebetween and providing the back portion spinal area; generally, each such section will be separately molded from a synthetic resinous material.

The toy may also include an elongated pivot piece spanning the hip area of the trunk member and providing generally spherical, laterally protruding portions on the opposite ends thereof. Each of the thigh components will have a socket of generally circular cross section formed into its upper part and dimensioned and configured to pivotably engage one of the end portions of the pivot piece therewithin, the end portions and thigh sockets thereby cooperatively providing the hip joints of the toy.

A pair of arm components will usually be laterally disposed on opposite sides of the trunk member, and will be positioned or capable of positioning entirely within the profile of the surface contour in the curled configuration of the toy. The arm components will generally be articulated by shoulder joints, and the toy will conveniently include a second such pivot piece, spanning the shoulder area of the trunk member, for that purpose; each arm component will of course be adapted to pivotably engage thereupon.

In their more specific form, the pivot pieces will be of dumbell-like configuration, with a flange element extending outwardly adjacent the base of each end portion. To cooperate therewith, the lateral trunk member sections will have non-circular openings through which the end portions of the pivot pieces protrude. The flange elements of the pivot pieces will be dimensioned to engage the surfaces of the sections about the openings, to secure the pivot pieces therebetween, and elements disposed on the end portions adjacent the flange elements will non-rotatably engage within the associated trunk member openings.

At least certain of the joints will preferably be comprised of contacting materials that are of different compositions. The materials will be selected to permit relatively free manual movement of the connected members and components, while at the same time exhibiting sufficient frictional resistance to inherently maintain the toy in whatever configuration is produced by manual manipulation of the several articulated parts.

DETAILED DESCRIPTION OF THE ILLUSTRATED EMBODIMENT

Figure 1:
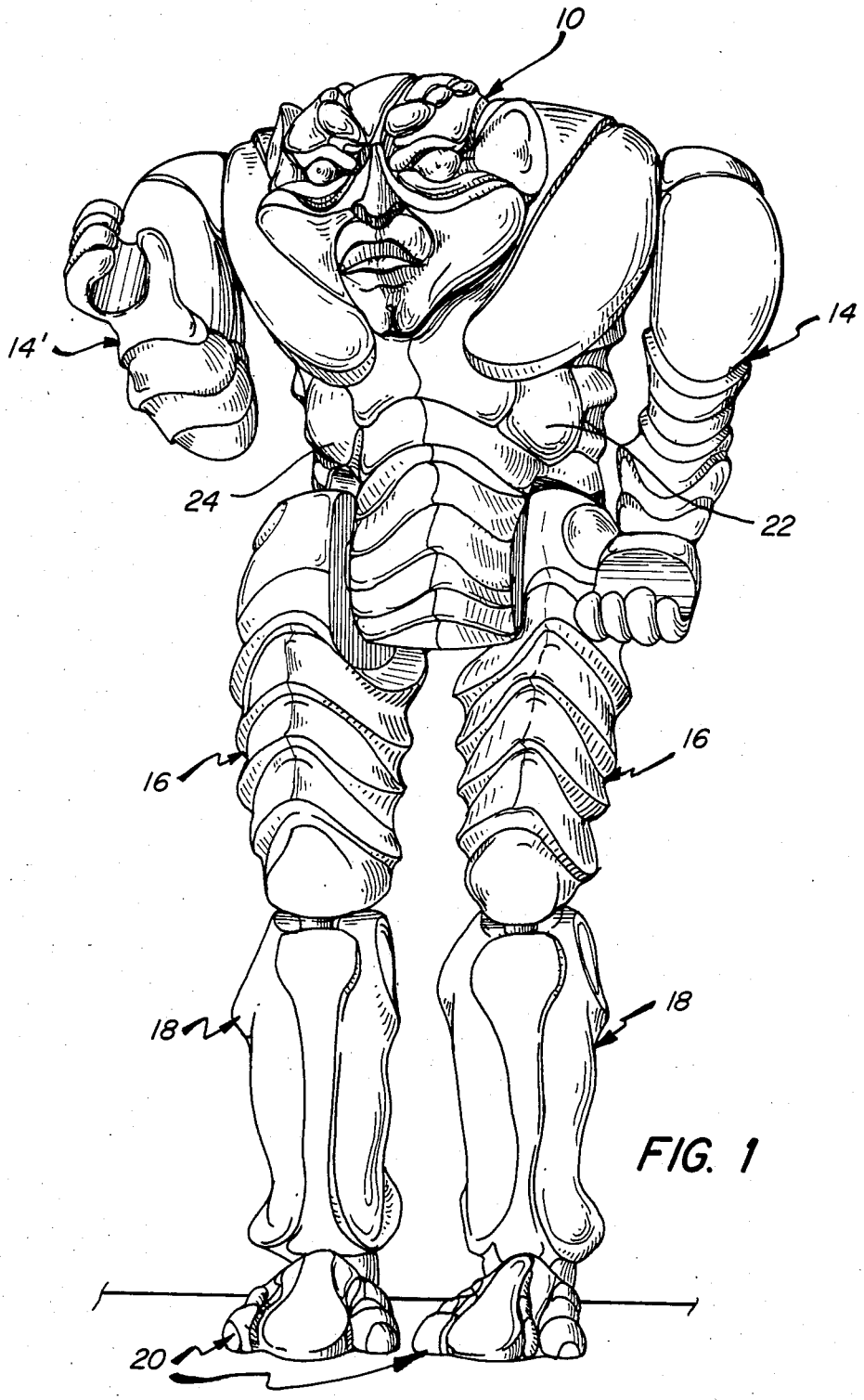
FIG. 1 is a perspective view of a humanoid figure toy embodying the present invention.
Figure 2:
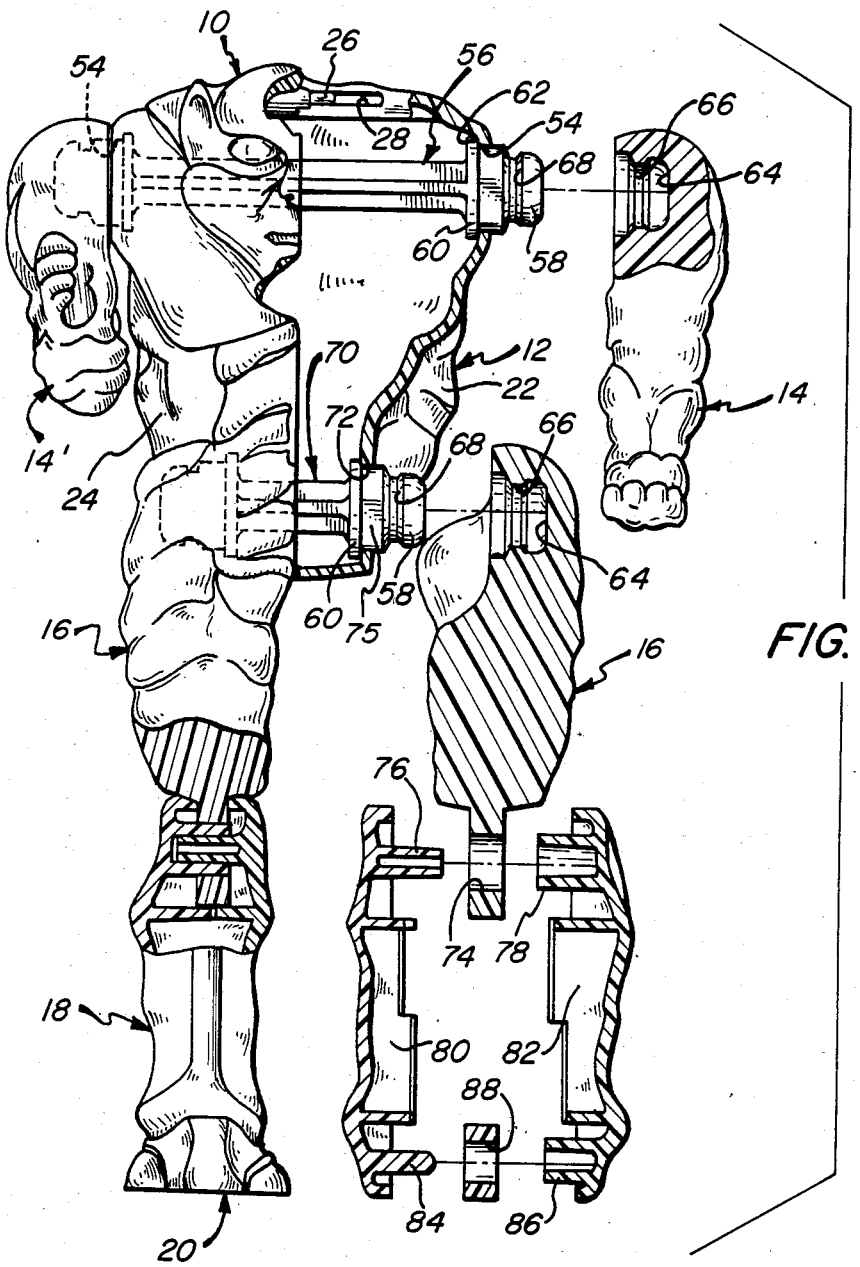
FIG. 2 is a front view of the toy of FIG. 1, shown in partial section and with certain parts in exploded relationship.
Figure 5:
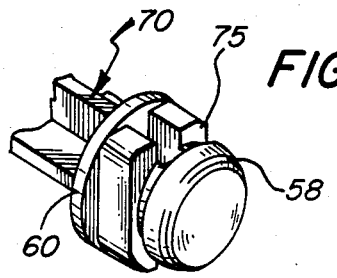
FIG. 5 is a fragmentary perspective view, in partial section and drawn to an enlarged scale, showing one of the pivot pieces.
Figure 6:
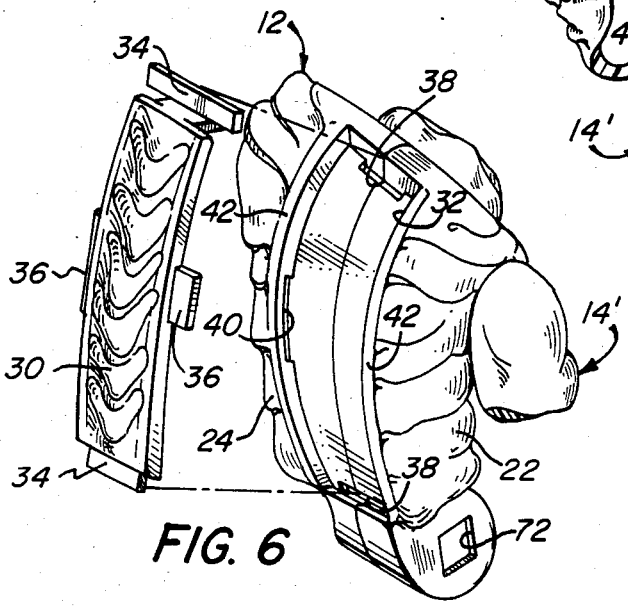
FIG. 6 is a fragmentary perspective view of the upper body parts of the figure, with the back panel of the trunk member assembly shown in exploded relationship.
Figure 3:
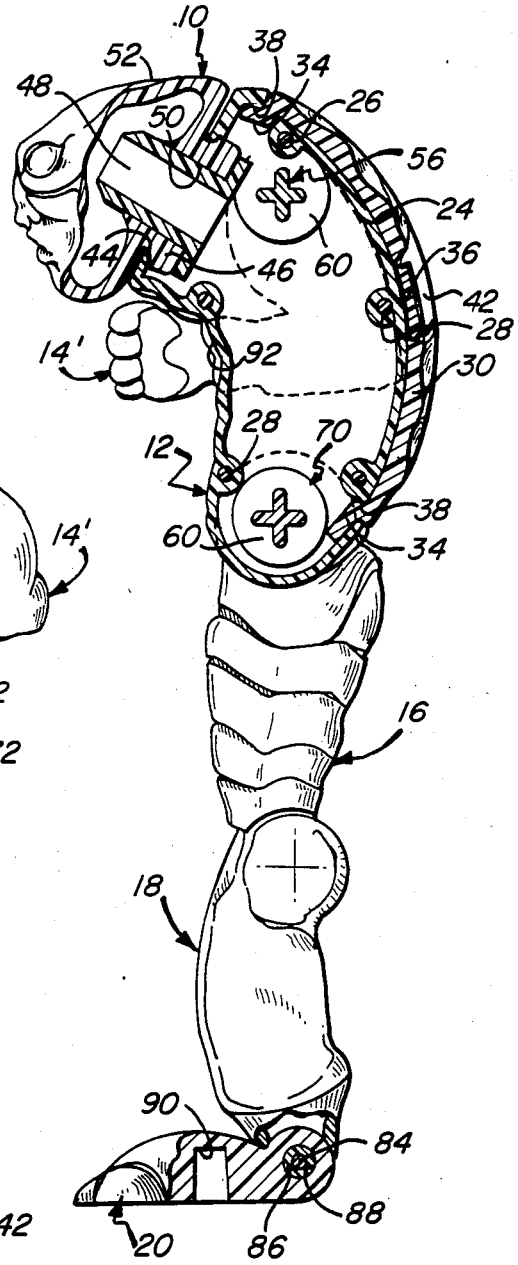
FIG. 3 is a side elevational view of the figure in standing position and with portions shown in section.

Turning now in detail to the appended drawings, therein illustrated is a figure toy embodying the present invention and consisting of a head member, a trunk member, and pairs of arm, thigh, leg and foot members, generally designated respectively by the numerals 10, 12, 14, 14', 16, 18 and 20. The trunk or body member 12 is comprised of two lateral sections 22, 24, which are joined to one another by appropriate means, such as sonic welding or adhesive bonding; conventional pins and bores 26, 28, best seen in FIGS. 2 and 3, are provided thereon to facilitate assembly. A back panel or strip 30 is seated within a recess 32 formed by the trunk sections 22, 24, and has end and lateral tab elements 34, 36, respectively, thereon which engage within corresponding slots 38, 40 to maintain the panel 30 in assembly.

The trunk member is formed with a hunched configuration to provide an arcuate back profile; generally parallel ridge elements 42 extend longitudinally thereon, and the surface of the panel 30, in the spinal area, is recessed therebetween. Separate fabrication of the lateral sections 22, 24 and the panel 30 permits molding of the parts without concern for undercut areas such as would otherwise be necessary in the tooling to accommodate molding of the spinal indentation, and the ability to do so constitutes a unique feature of the invention.

Figure 4:
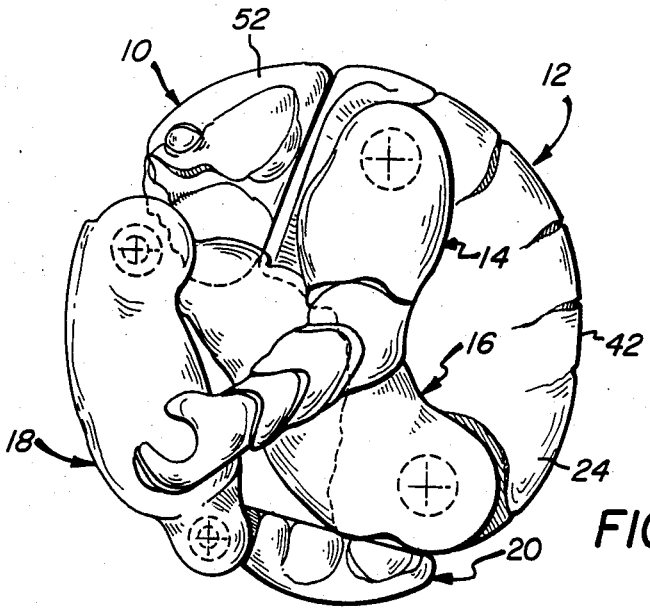
FIG. 4 is a side elevational view of the figure of the foregoing figures folded into its curled, generally cylindrical configuration.

A relatively large circular opening 44 is formed at the upper end of the trunk member 12, within which the head member 10 is rotatably engaged. The latter is desirably fabricated from a material such as PVC of 80 durometer value, and has a neck portion 46 which projects through the opening 44. A relatively rigid plug 48 extends into the aperture 50 of the neck portion 46 from the opposite direction, and thereby serves to maintain the head member 10 in assembly. The upper skull portion 52 of the head member is curved, and has substantially the same radius as the ridge elements 42 of the trunk member 12; hence it forms an arcuate surface section which cooperates in providing the cylindrical form (or circular profile) of the curled figure, as seen in FIG. 4.

Lateral openings 54 are provided in the shoulder areas of the two sections 22, 24, across which spans a dumbell-shaped pivot piece, generally designated by the numeral 56. The end portions 58 of the piece 56 are of knob-like, generally hemispherical form, and protrude through the opposite openings 54. Flange elements 60 at the base of the portions 58 bear upon the surrounding inner surfaces 62 of the trunk member sections 22, 24, which therefore serve to mount the pivot piece 56 in proper position when the sections are assembled with one another.

Each of the arm members 14, 14' has a socket 64 formed into its inner surface, which is dimensioned and configured to engage the corresponding end portion 58 of the pivot piece 56. A circumferential rib element 66 engages within a corresponding groove 68 of the associated portion 58 to provide pivotable mounting, the arm members being made of a material that is sufficiently resilient to permit facile assembly. Although, the two members 14, 14' are of somewhat different shape, in the curled configuration of the figure both arms lie within the cylindrical contour thereof (as seen in FIGS. 3 and 4).

The thigh members 16 are attached in much the same manner as the arm members. Thus, a similar (but somewhat shorter) dumbell-shaped pivot piece, generally designated by the numeral 70, is mounted between the body sections 22, 24 by engagement within hip area openings 72 provided thereby. Here too, the pivot piece has circular flange elements 62 at the base of the knob-like end portions 58, and the latter are received within corresponding sockets 64 formed within the thigh members, for snap-fit, pivotal interengagement. It will be noted however that the openings 72 are generally square, and that the pivot piece 70 has an element 75 of corresponding shape adjacent each flange element 62, which serve to lock the pivot piece 70 against rotation within the trunk openings 72. Although not illustrated, it will be appreciated that the same structure and function are provided and performed by the shoulder openings 54 and pivot piece 56, for the arm components 14, 14'.

The lower end of each thigh member 16 is formed with a circular aperture 74 (see FIG. 2), through which cooperating pin and socket elements 76, 78, respectively, on leg components 80, 82, extend to provide a pivotable mounting, the pin element 76 being frictionally engaged within the socket of the element 78. The lower end of the leg sections 80, 82 are similarly joined by pin and socket elements 84, 86, and provide the means for pivotably mounting foot member 20, which has circular aperture 88 therethrough for that purpose. As indicated in FIG. 3, each foot member also has a socket 90 extending upwardly from its bottom surface, which may be used for supporting the figure on a suitable stand, if so desired.

The manner of folding the toy figure into the curled configuration of FIG. 4, to adapt it for rolling along a flat surface, is as follows: The thigh members 16 are pivoted anteriorly upon the pivot piece 70 to positions against the concave chest area 92 of the trunk member 12, and the leg and foot members 18, 20 are pivoted posteriorly to positions along the rear portions of the respective thigh members 16, the foot members 20 thereby being brought into contact with the hip area of the curled figure.

Although it will readily be appreciated by those skilled in the art that the figure toy will normally be made predominantly from synthetic resinous materials, proper selection thereof will contribute to the achievement of objects of the invention. The several rigid parts of the figure must not only be articulatable in the manner described, but they should also be capable of inherently maintaining the relationships to which they are manipulated. By utilizing different plastics for at least the contacting surfaces of the members that are joined to one another, desirable levels of frictional resistance may be provided. Thus, in particularly preferred embodiments the leg members, the body member and the pivot pieces will be fabricated from an ABS (acrylonitrile/butadine/styrene) resin, and the foot, thigh, arm and head members will be made of PVC (polyvinyl chloride) plastic. Of course, variations may be made not only in the selection of materials of construction, but also in the design of the figure itself, without departing from the scope of the invention.

Thus, it can be seen that the present invention provides a novel humanoid figure toy which is constructed to permit folding from a substantially erect posture to a substantially cylindrical curled configuration. The relatively rigid body parts and appendages are configured and joined to one another in such a manner as to permit the necessary conformation for facile folding into the curled configuration, and external features of the several parts enable rolling of the figure in that condition. Means is provided for convenient mounting of the appendages upon the trunk member, which means permits ready manipulation while, at the same time, affording sufficient frictional resistance for maintaining the figure parts in selected relative positions. The toy figure is effective in its appearance and utility, is durable, and is of relatively facile and inexpensive manufacture.

Having described the invention, what is claimed is:

1. A humanoid figure toy comprised of relatively rigid trunk, thigh, leg and foot members, articulated by joints at hip, knee and ankle locations, said members and joint being constructed to permit folding of said toy from a generally erect posture to a curled configuration with a generally cylindrical surface contour provided at least in part by surface portions of said trunk and leg members, the axis of said cylindrical contour extending laterally of said toy and said toy being rollable about said axis.

2. A humanoid figure toy comprised of relatively rigid trunk, thigh, leg and foot members, articulated by joints at hip, knee and ankle locations, said members and joints being constructed to permit folding of said toy from a generally erect posture to a curled configuration with a generally cylindrical surface contour, said thigh member being foldable anteriorly to a position substantially against the chest portion of said trunk member, and said leg and foot members being foldable posteriorly to positions substantially against a rear portion of said thigh member.

3. The toy claim 2 wherein said trunk member is of hunched form, said chest portion being concave to accommodate said thigh member thereagainst in said curled configuration of said figure, and the back portion of said trunk member being longitudinally curved to provide an arcuate section of said cylindrical surface.

4. The toy of claim 3 additionally including a head member attached to said trunk member, said head member having a curved upper portion providing an arcuate section of said cylindrical surface closely adjacent to, and substantially continuous with, said back portion arcuate section.

5. The toy of claim 3 wherein each of said thigh, leg and foot members comprises a pair of symmetrically disposed components, and wherein said joints interconnect said components to provide two articulated leg appendages on said trunk member.

6. The toy of claim 5 wherein said leg and foot components have shin and instep portions providing arcuate sections of said cylindrical surface.

7. The toy of claim 6 wherein said back, shin and instep portions have longitudinal ridges thereon substantially providing said arcuate sections thereof.

8. The toy of claim 5 additionally including an elongated pivot piece spanning the hip area of said trunk member and having generally spherical portions on the opposite ends thereof protruding laterally from said member; and wherein each of said thigh components has a socket of generally circular cross section formed into the upper part thereof and dimensioned and configured to pivotably engage one of said end portions of said pivot piece therewithin, said end portions and thigh sockets cooperatively providing said hip joints of said toy.

9. The toy of claim 8 wherein at least certain of said joints are comprised of contacting materials that are of different compositions, said compositions being selected to permit relatively free manipulation of the members and components connected at said certain joints while exhibiting sufficient frictional resistance to inherently maintain said toy in said erect posture and said curled configuration thereof, once attained.

10. The toy of claim 8 additionally including a pair of arm components laterally disposed on opposite sides of said trunk member, said arm components being positioned or capable of positioning entirely within the profile of said surface contour in said curled configuration of said toy.

11. The toy of claim 10 wherein said arm components are articulated by shoulder joints.

12. The toy of claim 11 additionally including a second such elongated pivot piece spanning the shoulder area of said trunk member, and wherein each of said arm components has a socket of generally circular cross section formed into the upper part thereof and dimensioned and configured to pivotably engage one of said end portions of said second pivot piece therewithin, said end portions and arm sockets cooperatively providing said shoulder joints of said toy.

13. The toy of claim 12 wherein said pivot pieces are each of dumbell-like configuration and have a flange element extending outwardly adjacent the base of each of said end portions thereof, wherein said lateral trunk member sections have non-circular openings therein through which said end portions protrude, and wherein each of said end portions has an element disposed adjacent said flange element configured to non-rotatably engage within the associated trunk member opening, said flange elements being dimensioned to engage the surfaces of said sections about said openings so as to mount said pivot pieces therebetween.

14. A humanoid figure toy comprised of relatively rigid trunk, thigh, leg and foot members, articulated by joints at hip, knee and ankle locations, said members and joints being constructed to permit folding of said toy from a generally erect posture to a curled configuration with a generally cylindrical surface contour, the back portion of said trunk member being longitudinally curved and having a pair of longitudinal ridges thereon substantially providing arcuate sections of said cylindrical surface disposed to either side of a spinal area of said trunk member, said spinal area being recessed therebetween.

15. The toy of claim 14 wherein said trunk member is an assembly comprised of three sections, two lateral ones of said sections being of substantially mirror image form, taken through the medial plane of said member, and the third of said sections being an elongated panel disposed between said lateral sections and providing said back portion spinal area thereof.

16. The toy of claim 15 wherein each of said sections is separately molded from synthetic resinous materials.

* * * * *